US007211774B2

(12) United States Patent
Chen et al.

(10) Patent No.: US 7,211,774 B2
(45) Date of Patent: May 1, 2007

(54) INDUCTION HEATING SYSTEM

(75) Inventors: Yen-Fu Chen, Austin, TX (US); John W. Dunsmoir, Round Rock, TX (US); Francis X. Kinstler, Dripping Springs, TX (US); Sheryl S. Kinstler, Dripping Springs, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/207,916

(22) Filed: Aug. 19, 2005

(65) Prior Publication Data

US 2007/0039948 A1 Feb. 22, 2007

(51) Int. Cl.
*H05B 6/10* (2006.01)
*H05B 6/02* (2006.01)

(52) U.S. Cl. ..... 219/634; 219/600

(58) Field of Classification Search ..... 219/634, 219/730, 618, 754, 600; *H05B 6/10, 6/02*
See application file for complete search history.

(56) References Cited

U.S. PATENT DOCUMENTS 3,781,506 A 12/1973 Ketchum et al.
6,043,469 A * 3/2000 Fink et al. ..... 219/634
6,124,581 A 9/2000 Ulrich
6,672,367 B2 * 1/2004 Crafton et al. ..... 164/5
6,713,737 B1 * 3/2004 Verhagen ..... 219/667
6,727,483 B2 4/2004 Thomas et al.
6,910,522 B2 * 6/2005 Crafton et al. ..... 164/404
6,956,189 B1 * 10/2005 Verhagen ..... 219/632
7,015,439 B1 * 3/2006 Thomas et al. ..... 219/667
7,019,270 B2 * 3/2006 Verhagen ..... 219/667
7,036,424 B2 * 5/2006 Friel, Sr. ..... 99/327
2002/0092846 A1 7/2002 Yamamoto et al.
2003/0213799 A1 11/2003 Tanaka et al.

* cited by examiner

*Primary Examiner*—Daniel L. Robinson
(74) *Attorney, Agent, or Firm*—David A. Mims, Jr.; Rudolf O. Sieqesmund; Gordon & Rees, LLP

(57) ABSTRACT

The invention is an induction heating system comprising a first article having a metallic mesh lining; and a second article having a coil for receiving an alternating electrical current; wherein the coil induces a current in the metallic mesh lining when the second pad is placed in close proximity to the first pad and the coil receives an alternating electrical current; whereby the current induced in the metallic mesh lining causes the metallic mesh lining to generate heat that can be applied to a body through contact with the first article. Additionally, this inventive induction heating system may further comprise a controller circuit in the second article for detecting an eddy current in the coil and operating a switch to turn the alternating electrical current off when no eddy current is detected in the coil.

3 Claims, 1 Drawing Sheet

INDUCTION HEATING SYSTEM

FIELD OF THE INVENTION

The present invention is related generally to inductive heating devices, and more particularly to an inductive heating device for applying heat to the body of a human.

BACKGROUND OF THE INVENTION

Heat is widely used to treat various types of illness and injury. Heated garments or pads of various sizes and shapes often are used to apply heat to a given area of the body affected by the illness or injury.

Many heating pads simply store heat energy from an external source, such as an oven, but the heat from these types of devices dissipates and eventually disappears completely. Consequently, these devices quickly lose their effectiveness.

Other types of heating pads include an internal heat source that can provide continuous heat, but these devices typically rely on electricity and resistance heating to power the internal heat source. Cords or bulky batteries are required to provide the necessary electricity. Such cords or batteries can interfere with a patient's mobility and also expose the patient to a risk of electrocution or strangulation.

Thus, current methods of heating a garment or pad are often cumbersome and ineffective, and there is a need for a system that can provide continuous heat without electrical cords or batteries.

Induction heating is a well-known method for producing heat in an object without the need for wires or batteries, and has been used for some time in such diverse applications as cooking appliances and welding tools. See, e.g., U.S. Pat. No. 6,124,581 (issued Sep. 26, 2000), U.S. Pat. No. 6,727,483 (issued Apr. 27, 2004). In general an induction heating system requires a coil and an alternating electrical current. When connected to the alternative electrical current, the coil produces a varying magnetic field. In turn, the magnetic field induces an electric current in an object when the object is placed within the magnetic field. The resistance to electric current in the object causes the object to emit heat.

Notwithstanding current applications of induction heating, though, no known product applies the principles of induction heating to address the need for a garment or pad that can provide continuous heat without electrical cords or batteries.

SUMMARY OF THE INVENTION

The present invention is an induction heating system comprising a first article having a metallic mesh lining; and a second article having a coil for receiving an alternating electrical current; wherein the coil induces a current in the metallic mesh lining when the second pad is placed in close proximity to the first pad and the coil receives an alternating electrical current; whereby the current induced in the metallic mesh lining causes the metallic mesh lining to generate heat that can be applied to a body through contact with the first article.

Additionally, this inventive induction heating system may further comprise a controller circuit in the second article for detecting an eddy current in the coil and operating a switch to turn the alternating electrical current off when no eddy current is detected in the coil.

BRIEF DESCRIPTION OF DRAWINGS

The novel features believed characteristic of the invention are set forth in the appended claims. The invention itself, however, as well as a preferred mode of use, further objectives and advantages thereof, will be understood best by reference to the following detailed description of an illustrative embodiment when read in conjunction with the accompanying drawings, wherein:

DETAILED DESCRIPTION OF THE PREFERRED EMBODIMENT

Figure 1:
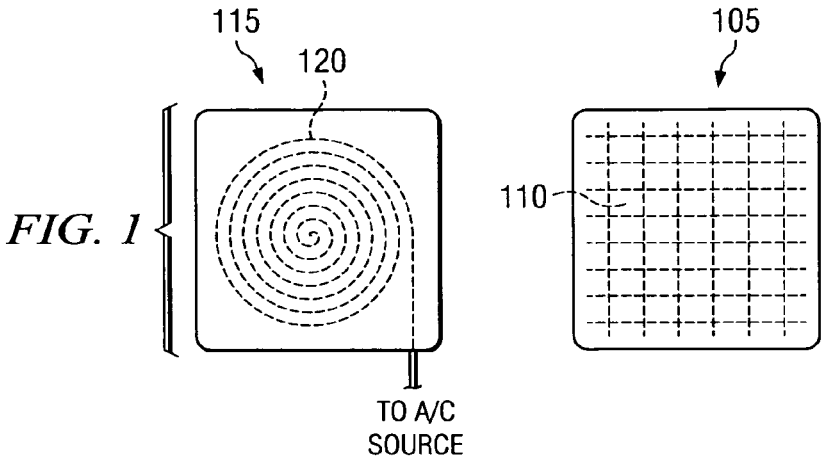
FIG. 1 is a top view of an embodiment of the present invention.

The invention described in detail below is a method and apparatus for providing a continuous source for heat that can be applied to a person without electrical cords or batteries. Referring to FIG. 1 for illustration, the invention comprises a first article 105 having a metallic mesh lining 110 that is resistant to an electrical current, and a second article 115 having a coil 120 for receiving an alternating electrical current and for generating a magnetic field around the second article when an alternating electrical current is applied to coil 120. Coil 120 in second article 115 induces a current in metallic mesh lining 110 when second article 115 is placed in proximity to first article 105 and coil 120 in second article 115 receives an alternating current (A/C). Metallic mesh lining 110 resists the induced current, thereby causing metallic mesh lining 110 to emit heat.

The current in metallic mesh lining 110, in turn, creates eddy currents in second article 115, and an optional controller circuit can be integrated into second article 115 to detect such eddy currents. In one embodiment of the invention, the controller comprises a conductor detection module that detects the presence (or absence) of a ferrous or non-ferrous conductor in first article 105. The controller further comprises a service module that operates a switch to the alternating electrical current source. Accordingly, such a controller can detect the presence of first article 105 and switch the alternating electrical current source on and off as first article 105 is moved in and out of range. Moreover the strength of the eddy currents is proportional to the amount of heat generated in first article 105, and the controller can adjust the current through coil 120 as needed to control the heat in first article 105. In a preferred embodiment of the invention, coil 120 is a copper coil having a diameter of three inches, and the alternating electrical current source applies fifty volts at 50–60 cycles per second, with a maximum of fifty watts per coil. This embodiment can produce a pulse output in increments of 0.1 seconds, which can be controlled for precise generation of heat.

The present invention has many too many applications to possibly enumerate them all here. Instead, a few broad examples are provided that illustrate some of the broader applications and the preferred modes of operation.

In one embodiment, the second article is a pad that is placed in a bed or chair, and the first article is a garment or pad that is worn by or placed upon a patient or other person in need of therapeutic heat. The first article is activated when the patient sits in the chair or lies in the bed.

Figure 2:
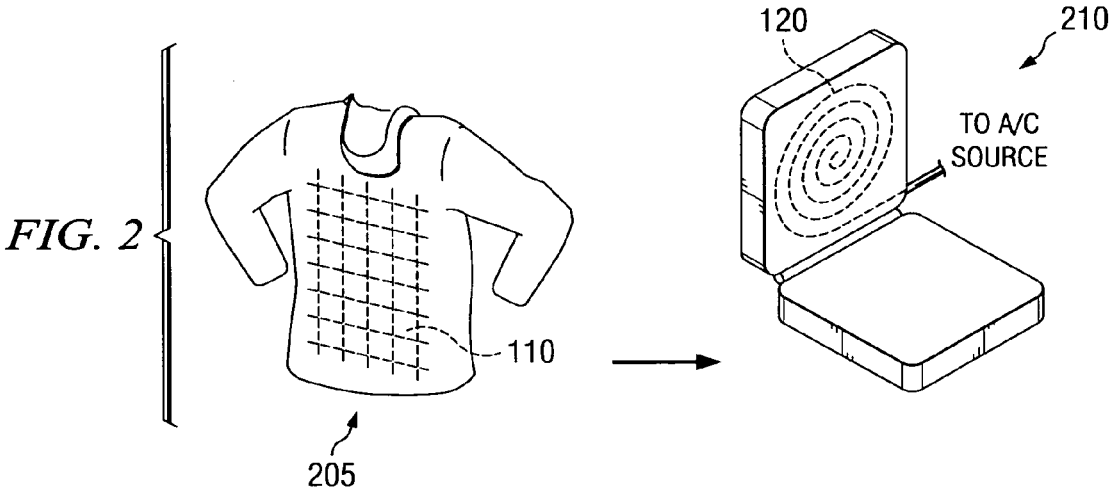
FIG. 2 is an oblique view of an alternate embodiment of the present invention.

FIG. 2 illustrates another embodiment, in which the first article is an article of clothing 205, such as trousers or a ski jacket, having metallic mesh lining 110. The second article is a seat 210, such as a ski lift chair, into which coil 120 is inserted. Thus, heat is generated in article of clothing 205 when a person wearing article of clothing 205 sits in seat 210. Alternatively, coil 120 is inserted into stadium seats and metallic mesh lining 110 is incorporated into clothing worn by spectators. Again, heat is generated in the metallic mesh lining when a spectator sits in the seat.

Figure 3:
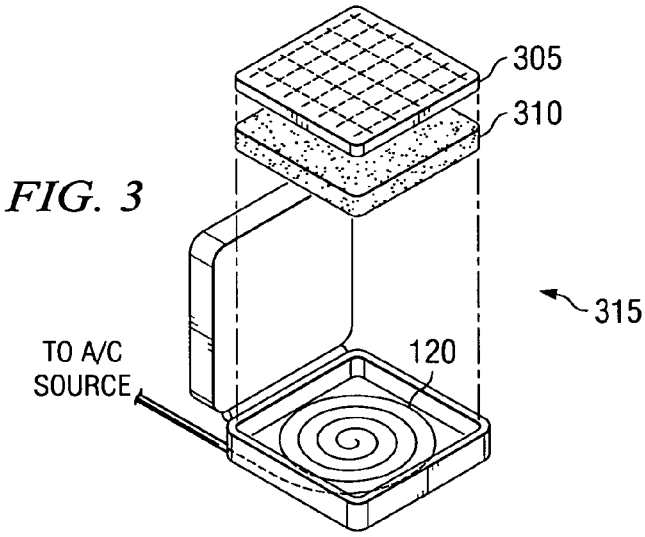
FIG. 3 is an exploded oblique view of an alternate embodiment of the present invention.

FIG. 3 illustrates yet another alternative embodiment, in which the first article is flexible metallic sheet 305. Here, flexible metallic sheet 305 provides the resistance element and eliminates the need for the metallic mesh lining. Alternatively, the first article is a pad having metallic mesh lining. In either instance, the second article is a seat 315 and the first article is inserted into or attached to the top of compressible layer 310, such as foam rubber. Metallic sheet 305 and compressible layer 310 then are placed upon or attached to the base of seat 315 having coil 120. Then, when anyone sits on the seat, compressible layer 310 is compressed and the metallic sheet moves closer to coil 120, which in turn induces heat in metallic sheet 305.

Other useful embodiments include blankets and shoe warmers, furniture, and golf carts.

A preferred form of the invention has been shown in the drawings and described above, but variations in the preferred form will be apparent to those skilled in the art. The preceding description is for illustration purposes only, and the invention should not be construed as limited to the specific form shown and described. The scope of the invention should be limited only by the language of the following claims.

What is claimed is:

1. An induction heating system comprising:

a first article having a metallic mesh lining; and a second article having a coil for receiving an alternating electrical current; and a controller circuit in the second article for detecting an eddy current in the coil and operating a switch to turn the alternating electrical current off when no eddy current is detected in the coil;

wherein the coil induces a current in the metallic mesh lining when the second article is placed in close proximity to the first article and the coil receives an alternating electrical current;

whereby the current induced in the metallic mesh lining causes the metallic mesh lining to generate heat that can be applied to a body through contact with the first article.

2. The induction beating system of claim 1 wherein:

the first article is a first pad for placement upon a person; and the second article is a second pad for placement in a bed.

3. The induction heating system of claim 2 wherein the first pad is a blanket.

* * * * *